US009120608B2

(12) United States Patent
Sullivan et al.

(10) Patent No.: US 9,120,608 B2
(45) Date of Patent: Sep. 1, 2015

(54) SUSTAINABLE PACKAGING SYSTEM FOR SHIPPING LIQUID OR VISCOUS PRODUCTS

(75) Inventors: Joseph Sullivan, Plymouth, MA (US); Bob Buchenen, Sandwich, MA (US); Stephen L. Gosling, Kingston, MA (US)

(73) Assignee: CDF Corporation, Plymouth, MA (US)

( * ) Notice: Subject to any disclaimer, the term of this patent is extended or adjusted under 35 U.S.C. 154(b) by 297 days.

(21) Appl. No.: 12/767,981

(22) Filed: Apr. 27, 2010

(65) Prior Publication Data

US 2011/0114714 A1 May 19, 2011

Related U.S. Application Data

(63) Continuation-in-part of application No. 12/620,446, filed on Nov. 17, 2009, now Pat. No. 8,567,660.

(51) Int. Cl.
*B65D 5/56* (2006.01)
*B65B 3/02* (2006.01)
(Continued)

(52) U.S. Cl.
CPC ..... *B65D 77/062* (2013.01); *B65D 5/5425* (2013.01); *B65D 5/566* (2013.01); *B65D 5/60* (2013.01); *B65D 5/68* (2013.01); *B65D 43/0212* (2013.01); *B65D 77/0413* (2013.01);
(Continued)

(58) Field of Classification Search
CPC ..... B65D 2543/00296; B65D 2543/00685; B65D 2519/00711; B65D 2543/00462; B65D 2543/00472; B65D 45/18
USPC ..... 229/117.3, 164.2, 125.05; 220/495.05, 220/23.91, 495.03, 255, 802; 426/411
See application file for complete search history.

(56) References Cited

U.S. PATENT DOCUMENTS 875,780 A 1/1908 Coats
931,808 A 8/1909 Smith
(Continued)

FOREIGN PATENT DOCUMENTS

CA 1 159 379 12/1983
CA 2 156 796 2/1997
(Continued)

OTHER PUBLICATIONS

Advertisement, "Designed with Food in Mind, the Unifold Food Grade Intermediate Bulk Container," LB Systemer a/s Uni-Fold, Nordgarde 1A-4520 Svinninge Denmark, 5 pgs. Date unknown.
(Continued)

*Primary Examiner* — Christopher Demeree
(74) *Attorney, Agent, or Firm* — Dorsey & Whitney LLP

(57) ABSTRACT

The present disclosure, in one embodiment, relates to a packaging assembly for holding liquids, viscous material, or particulate material. The packaging assembly includes a carton having side and bottom walls. The packaging assembly also includes a self-supporting plastic liner that fits inside of the carton for containing liquids, viscous material, or particulate material. The liner has either a substantially circular or substantially oval cylindrical side wall, a closed bottom end characterized by a bottom wall formed integral with said side wall, and an open top end having an outwardly-projecting rim. The rim has a radially-extending flange portion, and a dependent skirt portion, wherein when the self-supporting plastic liner is inside of the carton, the radially extending flange portion supports the liner on at least a portion of the carton. A lidding material is provided to seal the plastic liner.

24 Claims, 12 Drawing Sheets

(51) Int. Cl.

| | |
|---|---|
| ***B65D 77/06*** | (2006.01) |
| ***B65D 5/54*** | (2006.01) |
| ***B65D 5/60*** | (2006.01) |
| ***B65D 5/68*** | (2006.01) |
| ***B65D 43/02*** | (2006.01) |
| ***B65D 77/04*** | (2006.01) |
| ***B65D 77/20*** | (2006.01) |
| ***B65D 83/00*** | (2006.01) |

(52) U.S. Cl.

CPC ..... *B65D77/2024* (2013.01); *B65D 83/0005* (2013.01); *B65D 2543/0062* (2013.01); *B65D 2543/0074* (2013.01); *B65D 2543/00203* (2013.01); *B65D 2543/00296* (2013.01); *B65D 2543/00527* (2013.01); *B65D 2543/00537* (2013.01); *B65D 2543/00685* (2013.01)

(56) References Cited

U.S. PATENT DOCUMENTS

| | | | | |
|---|---|---|---|---|
| 1,120,058 | A | | 12/1914 | Hutto |
| 1,132,000 | A | | 3/1915 | Dight |
| 1,135,866 | A | | 4/1915 | Turner |
| 1,875,497 | A | * | 9/1932 | Richardson et al. ..... 206/586 |
| 1,975,198 | A | | 10/1934 | Doleman |
| 2,083,776 | A | | 6/1937 | Ferguson |
| 2,155,057 | A | | 4/1939 | Moore |
| 2,260,064 | A | | 10/1941 | Stokes |
| 2,333,587 | A | | 11/1943 | Salfisberg |
| 2,339,156 | A | | 1/1944 | Davis |
| 2,339,665 | A | | 1/1944 | Alman |
| 2,352,503 | A | | 6/1944 | Walton |
| 2,446,308 | A | | 8/1948 | Smith |
| 2,720,998 | A | | 10/1950 | Potter |
| 2,533,554 | A | | 12/1950 | Byerly |
| 2,638,263 | A | | 5/1953 | Jesnig |
| 2,738,796 | A | | 3/1956 | Chadwick |
| 2,757,669 | A | | 8/1956 | Gewecke et al. |
| 2,791,367 | A | | 5/1957 | Mefford |
| 2,799,314 | A | | 7/1957 | Dreyer et al. |
| 794,125 | A | | 4/1958 | Locke |
| 2,853,223 | A | | 9/1958 | Paflas |
| 2,902,202 | A | | 9/1959 | Fallert |
| 2,930,423 | A | | 3/1960 | Cunningham |
| 2,950,037 | A | | 8/1960 | Orsini |
| 2,951,628 | A | | 9/1960 | Grussen |
| 2,956,839 | A | | 10/1960 | Hermanns |
| 2,973,119 | A | | 2/1961 | Parker |
| 3,006,257 | A | | 10/1961 | Orsini |
| 3,039,656 | A | | 6/1962 | Wentz |
| 3,044,515 | A | | 7/1962 | Eades |
| 3,087,491 | A | | 4/1963 | Gewecke et al. |
| 3,119,548 | A | | 1/1964 | Cook et al. |
| 3,143,277 | A | | 8/1964 | LaFleur |
| 3,208,658 | A | | 9/1965 | Membrino |
| 3,217,949 | A | | 11/1965 | Davis |
| 3,224,640 | A | | 12/1965 | Schneider |
| 3,244,576 | A | | 4/1966 | Swartz |
| 3,253,764 | A | | 5/1966 | Goetschius |
| 3,275,197 | A | | 9/1966 | Eklund |
| 3,289,386 | A | | 12/1966 | Farmer |
| 3,294,270 | A | | 12/1966 | Geisler |
| 3,319,684 | A | | 5/1967 | Calhoun |
| 3,335,858 | A | | 8/1967 | Sibille |
| 3,349,991 | A | | 10/1967 | Kessler |
| 3,367,380 | A | | 2/1968 | Dickey |
| 3,370,774 | A | | 2/1968 | Hopf |
| 3,384,106 | A | | 5/1968 | Isbrandtsen |
| 3,386,645 | A | | 6/1968 | Powell |
| 3,415,440 | A | | 12/1968 | Watters |
| 3,434,652 | A | | 3/1969 | Shore |
| 3,447,732 | A | | 6/1969 | Jonas |
| 3,462,067 | A | | 8/1969 | Shore |
| 3,510,142 | A | | 5/1970 | Erke |
| 3,550,662 | A | | 12/1970 | Remke et al. |
| 3,559,847 | A | | 2/1971 | Goodrich |
| 3,620,399 | A | | 11/1971 | Rapeaud |
| 3,624,776 | A | | 11/1971 | Gordon |
| 3,670,916 | A | | 6/1972 | Alpert |
| 3,709,426 | A | | 1/1973 | Farkas |
| 3,739,977 | A | | 6/1973 | Shapiro et al. |
| 3,761,013 | A | | 9/1973 | Schuster |
| 3,836,217 | A | | 9/1974 | Shiina |
| 3,853,238 | A | | 12/1974 | Luisada et al. |
| 3,868,891 | A | | 3/1975 | Parish |
| 3,890,762 | A | | 6/1975 | Ernst et al. |
| 3,951,284 | A | | 4/1976 | Fell et al. |
| 3,965,953 | A | | 6/1976 | Becker et al. |
| 3,989,157 | A | | 11/1976 | Veenema |
| 3,995,806 | A | | 12/1976 | McSherry |
| 4,011,798 | A | | 3/1977 | Bambara et al. |
| 4,025,048 | A | | 5/1977 | Tibbitts |
| 4,056,913 | A | * | 11/1977 | Bamburg et al. ..... 53/449 |
| 4,085,244 | A | | 4/1978 | Stillman |
| 4,094,460 | A | | 6/1978 | Scanga et al. |
| 4,105,121 | A | | 8/1978 | Mascetti |
| 4,169,548 | A | | 10/1979 | Bond |
| 4,174,051 | A | | 11/1979 | Edwards et al. |
| 4,177,907 | A | | 12/1979 | Funaioli et al. |
| 4,184,527 | A | | 1/1980 | Kawamura |
| 4,211,226 | A | | 7/1980 | Schaar |
| 4,239,111 | A | | 12/1980 | Conant et al. |
| 4,267,960 | A | | 5/1981 | Lind et al. |
| 4,270,533 | A | | 6/1981 | Andreas |
| 4,305,535 | A | | 12/1981 | Brundige et al. |
| 4,309,466 | A | | 1/1982 | Stillman |
| 4,328,923 | A | | 5/1982 | Graser |
| 4,362,199 | A | | 12/1982 | Futerman |
| 4,421,253 | A | | 12/1983 | Croley |
| 4,430,084 | A | | 2/1984 | Deaton |
| 4,444,355 | A | | 4/1984 | Cary |
| 4,448,345 | A | | 5/1984 | Helms |
| 4,449,646 | A | | 5/1984 | Bonerb et al. |
| 4,457,456 | A | | 7/1984 | Derby et al. |
| 4,461,402 | A | | 7/1984 | Fell et al. |
| 4,466,553 | A | | 8/1984 | Zenger |
| 4,476,998 | A | | 10/1984 | Bonerb et al. |
| 4,482,074 | A | | 11/1984 | Lalley |
| 4,518,097 | A | | 5/1985 | Milton et al. |
| 4,524,459 | A | | 6/1985 | Titchenal |
| 4,548,321 | A | | 10/1985 | Mockesch et al. |
| 4,560,090 | A | | 12/1985 | Okushita |
| 4,561,107 | A | | 12/1985 | Herder |
| 4,596,040 | A | | 6/1986 | LaFleur et al. |
| 4,597,102 | A | | 6/1986 | Nattrass |
| RE32,232 | E | | 8/1986 | Bonerb et al. |
| 4,625,908 | A | | 12/1986 | Emery |
| 4,636,190 | A | | 1/1987 | Herder |
| 4,673,112 | A | | 6/1987 | Bonerb |
| 4,674,127 | A | | 6/1987 | Yamada et al. |
| 4,676,373 | A | | 6/1987 | Schneider |
| 4,715,508 | A | | 12/1987 | Schurch |
| 4,718,577 | A | | 1/1988 | Morris et al. |
| 4,730,942 | A | | 3/1988 | Fulcher |
| 4,781,472 | A | | 11/1988 | LaFleur et al. |
| 4,783,178 | A | | 11/1988 | Herder |
| 4,790,029 | A | | 12/1988 | LaFleur et al. |
| 4,796,788 | A | | 1/1989 | Bond |
| 4,804,113 | A | | 2/1989 | Ciaccio |
| 4,850,506 | A | | 7/1989 | Heaps et al. |
| 4,874,258 | A | | 10/1989 | Marino |
| 4,898,301 | A | | 2/1990 | Schick |
| 4,917,255 | A | | 4/1990 | Foy |
| 4,923,077 | A | | 5/1990 | Van Iperen et al. |
| 4,931,034 | A | | 6/1990 | Wagner |
| 4,941,754 | A | | 7/1990 | Murdock |
| 4,997,108 | A | | 3/1991 | Hata |
| 4,998,990 | A | | 3/1991 | Richter et al. |
| 5,002,194 | A | | 3/1991 | Nichols |
| 5,020,922 | A | | 6/1991 | Schirmer |
| 5,025,982 | A | | 6/1991 | Lisiecki |
| 5,029,734 | A | | 7/1991 | Nichols |
| 5,037,002 | A | | 8/1991 | Tschanen |

(56) References Cited

U.S. PATENT DOCUMENTS

| | | | | |
|---|---|---|---|---|
| 5,040,693 | A | 8/1991 | Podd et al. | |
| 5,054,644 | A | 10/1991 | Greenslade | |
| 5,056,667 | A | 10/1991 | Coogan | |
| 5,074,460 | A | 12/1991 | Hanekamp | |
| 5,094,359 | A | 3/1992 | DeMars et al. | |
| 5,096,092 | A | 3/1992 | Devine | |
| 5,104,236 | A | 4/1992 | LaFleur | |
| 5,120,586 | A | 6/1992 | Nedzu et al. | |
| 5,127,893 | A | 7/1992 | LaFleur | |
| 5,156,291 | A | 10/1992 | Mielke | |
| 5,193,710 | A | 3/1993 | Podd et al. | |
| 5,195,661 | A | 3/1993 | Light | |
| 5,253,763 | A | 10/1993 | Kirkley et al. | |
| 5,265,797 | A | 11/1993 | Velge et al. | |
| 5,269,414 | A | 12/1993 | D'Hollander | |
| 5,290,499 | A | 3/1994 | Tischler | |
| 5,292,026 | A | 3/1994 | Stolzman | |
| 5,302,402 | A | 4/1994 | Dudenhoeffer et al. | |
| 5,307,986 | A | 5/1994 | Schuster | |
| 5,314,086 | A | 5/1994 | Short | |
| 5,314,250 | A | 5/1994 | Lee | |
| 5,330,069 | A | 7/1994 | Jamison et al. | |
| 5,335,820 | A | 8/1994 | Christianson | |
| 5,337,915 | A * | 8/1994 | Hall, Jr. | 220/495.11 |
| 5,338,117 | A | 8/1994 | Kucksdorf et al. | |
| 5,341,952 | A | 8/1994 | Goglio | |
| 5,344,048 | A | 9/1994 | Bonerb | |
| 5,344,065 | A | 9/1994 | Moran | |
| 5,350,239 | A | 9/1994 | Strand et al. | |
| 5,368,395 | A | 11/1994 | Crimmins | |
| 5,400,916 | A | 3/1995 | Weber | |
| 5,427,306 | A | 6/1995 | Petriekis et al. | |
| 5,487,470 | A | 1/1996 | Pharo | |
| 5,489,037 | A | 2/1996 | Stopper | |
| 5,492,270 | A | 2/1996 | Avery et al. | |
| 5,494,394 | A | 2/1996 | Podd et al. | |
| 5,499,743 | A | 3/1996 | Blumenkron | |
| 5,531,361 | A | 7/1996 | Podd | |
| 5,547,284 | A | 8/1996 | Imer | |
| 5,549,944 | A | 8/1996 | Abate | |
| 5,588,549 | A | 12/1996 | Furtner | |
| 5,618,254 | A | 4/1997 | Derby | |
| 5,636,764 | A | 6/1997 | Bonerb | |
| 5,660,299 | A | 8/1997 | Harvey | |
| 5,692,546 | A | 12/1997 | Podd et al. | |
| 5,711,444 | A | 1/1998 | Meacham et al. | |
| 5,765,723 | A | 6/1998 | Wilcox | |
| 5,775,541 | A | 7/1998 | Perkins | |
| 5,788,121 | A | 8/1998 | Sasaki et al. | |
| 5,799,818 | A | 9/1998 | Ringer | |
| 5,851,072 | A | 12/1998 | LaFleur | |
| 5,857,612 | A | 1/1999 | Smith et al. | |
| 5,865,541 | A | 2/1999 | LaFleur | |
| 5,915,596 | A | 6/1999 | Credle, Jr. | |
| 5,918,984 | A | 7/1999 | LaFleur et al. | |
| 5,924,302 | A | 7/1999 | Derifield | |
| 5,941,421 | A | 8/1999 | Overman et al. | |
| 5,984,850 | A | 11/1999 | Derby | |
| 5,988,422 | A | 11/1999 | Vallot | |
| 6,120,181 | A | 9/2000 | Wilcox | |
| 6,139,482 | A | 10/2000 | LaFleur | |
| 6,164,526 | A | 12/2000 | Dalvey | |
| 6,193,416 | B1 | 2/2001 | Kawamata et al. | |
| 6,234,351 | B1 | 5/2001 | Wilcox | |
| 6,325,281 | B1 | 12/2001 | Grogan | |
| 6,332,711 | B1 | 12/2001 | Inuzuka et al. | |
| 6,360,558 | B1 | 3/2002 | Woog | |
| 6,371,646 | B1 | 4/2002 | LaFleur | |
| 6,374,579 | B1 | 4/2002 | Muller | |
| 6,378,733 | B1 | 4/2002 | Boonzaier | |
| 6,427,873 | B2 | 8/2002 | Wilcox | |
| 6,443,617 | B2 | 9/2002 | Tetenborg | |
| 6,467,652 | B2 | 10/2002 | Wilcox et al. | |
| 6,527,445 | B2 | 3/2003 | LaFleur et al. | |
| 6,533,122 | B1 | 3/2003 | Plunkett | |
| 6,536,687 | B1 | 3/2003 | Navis et al. | |
| 6,564,992 | B1 | 5/2003 | Wegner | |
| 6,588,681 | B2 | 7/2003 | Rothrum et al. | |
| 6,595,441 | B2 | 7/2003 | Petrie et al. | |
| 6,607,097 | B2 | 8/2003 | Savage et al. | |
| 6,644,510 | B2 | 11/2003 | Kawolics et al. | |
| 6,663,018 | B2 | 12/2003 | Rothrum et al. | |
| 6,752,179 | B1 | 6/2004 | Schwartz | |
| 6,868,982 | B2 | 3/2005 | Gordon | |
| 6,883,683 | B1 | 4/2005 | Cunningham et al. | |
| 6,892,933 | B2 | 5/2005 | Sullivan, Jr. | |
| 6,910,582 | B2 | 6/2005 | Lantz | |
| 7,077,309 | B2 | 7/2006 | Andrews | |
| 7,080,750 | B2 * | 7/2006 | Wein et al. | 220/495.01 |
| 7,244,064 | B2 | 7/2007 | Sullivan, Jr. | |
| 7,252,196 | B1 | 8/2007 | Koefelda et al. | |
| 7,334,702 | B2 | 2/2008 | Cunningham et al. | |
| 2002/0071922 | A1 | 6/2002 | Bailey | |
| 2002/0148857 | A1 | 10/2002 | Savage et al. | |
| 2002/0164089 | A1 | 11/2002 | LaFleur et al. | |
| 2003/0235349 | A1 | 12/2003 | Ricahrdson, Jr. et al. | |
| 2004/0118741 | A1 | 6/2004 | Sullivan, Jr. | |
| 2005/0017011 | A1 | 1/2005 | Andrews | |
| 2005/0072181 | A1 | 4/2005 | Mogil et al. | |
| 2005/0078890 | A1 | 4/2005 | Abe et al. | |
| 2005/0082303 | A1 | 4/2005 | Cantwell et al. | |
| 2005/0100252 | A1 | 5/2005 | Rivlin et al. | |
| 2005/0220369 | A1 | 10/2005 | Sullivan, Jr. | |
| 2005/0220639 | A1 | 10/2005 | Sasaki et al. | |
| 2006/0023973 | A1 | 2/2006 | Plunkett et al. | |
| 2006/0027586 | A1 | 2/2006 | Longhany et al. | |
| 2007/0076988 | A1 | 4/2007 | Sullivan et al. | |
| 2007/0201774 | A1 | 8/2007 | Plunkett et al. | |
| 2011/0225981 | A1 | 9/2011 | Glaros et al. | |
| 2012/0061386 | A1 | 3/2012 | Parsons | |

FOREIGN PATENT DOCUMENTS

| | | |
|---|---|---|
| DE | 60 598 | 11/1890 |
| DE | 1 486 433 | 4/1969 |
| DE | G 89 06 059.8 | 11/1989 |
| DE | 29620877 U1 | 2/1997 |
| DE | 19643837 A1 | 5/1998 |
| EP | 0 098 322 | 1/1984 |
| EP | 0 362 102 | 4/1990 |
| EP | 0 276 994 | 12/1992 |
| EP | 1 277 666 | 1/2003 |
| EP | 1 435 265 | 7/2004 |
| EP | 1 415 719 | 5/2009 |
| FR | 1 331 060 | 5/1963 |
| FR | 2 316 151 | 3/1977 |
| FR | 2 375 113 | 8/1978 |
| FR | 2 742 129 | 6/1997 |
| GB | 1 591 323 | 6/1981 |
| GB | 2 194 512 | 3/1988 |
| GB | 2 245 883 | 1/1992 |
| GB | 2 268 231 | 1/1994 |
| GB | 2 323 846 | 10/1998 |
| GB | 2 356 854 | 6/2001 |
| GB | 2440735 A | 2/2008 |
| JP | 64-009174 | 1/1989 |
| JP | 2-139383 | 5/1990 |
| JP | 5-221451 | 8/1993 |
| JP | 6-115557 | 4/1994 |
| JP | 6-122457 | 5/1994 |
| JP | 6-179455 | 6/1994 |
| JP | 6-255657 | 9/1994 |
| JP | 8-104391 | 4/1996 |
| WO | WO 82/03838 | 11/1982 |
| WO | WO 89/11422 | 11/1989 |
| WO | WO 98/32539 | 7/1998 |
| WO | 02/31417 A1 | 4/2002 |
| WO | WO 02/057151 | 7/2002 |
| WO | WO 02/064456 | 8/2002 |
| WO | WO 02/074226 | 9/2002 |

(56) References Cited

FOREIGN PATENT DOCUMENTS

| | | | |
|---|---|---|---|
| WO | WO 2007/038438 | | 4/2007 |
| WO | 2007/089282 | A2 | 8/2007 |
| WO | 2007/136750 | A2 | 11/2007 |

OTHER PUBLICATIONS

Advertisement, "Stocklin, Collapsible Container, innovative and Environment-Friendly Packaging," Walter Stocklin AG, Forder Und Lagertechnik, CH-4143 Dornach/Schweiz, 4 pgs. Date unknown.
Advertisement, "CFS Developments (Proprietary) Ltd.," Postal Address: P.O. Box 4852 Luipaardsvlei 1743 South Africa, 4 pgs. Date unknown.
Advertisement, "Reusable Container Systems, Industry Leader in quality, innovation and service," Ropak Corporation, Materials Handling Group, A Member of the Linpac Group of Companies, 7 pgs. Date unknown.
Advertisement, "ECONOBOX, A Whole New Dimension, Cost-effective Solutions for Materials Handling," GE Polymer Logistics, 3 pgs. Date unknown.
Advertisement, "Introducing the Arena 330 Shipper, It beats the drum and everything else," GE Silicones, A. R. Arena Products, Inc., 2101 Mt. Read Blvd., Rochester, New York, 1465, 4 pgs. Date unknown.
Advertisement, TNT Container Logistics, Containers for Hazardous Goods, Hazcon & Uni-Fold, 2 pgs. Date unknown.
Author unknown, "TNT: TNT Liquid Discharge Roller Arm," 2 pgs., date unkown.
International Search Report mailed Mar. 15, 2012, for International Application No. PCT/US2011/060919, 9 pages.
International Written Opinion mailed Mar. 15, 2012, for International Application No. PCT/US2011/060919, 8 pages.
International Search Report for Application No. PCT/US2010/056998, dated Nov. 17, 2010, 5 pages.

* cited by examiner

SUSTAINABLE PACKAGING SYSTEM FOR SHIPPING LIQUID OR VISCOUS PRODUCTS

CROSS-REFERENCE TO RELATED APPLICATION

The present application is a continuation-in-part of U.S. patent application Ser. No. 12/620,446, filed Nov. 17, 2009, now U.S. Pat. No. 8,567,660, titled "Sustainable Packaging System for Shipping Liquid or Viscous Products," the subject matter of which is incorporated herein by reference in its entirety.

FIELD OF THE INVENTION

The present disclosure relates to packaging and more particularly to a sustainable packaging system including a carton and a sealed liner assembly for shipping liquid, viscous, or particulate products.

BACKGROUND OF THE INVENTION

Substantially rigid plastic containers with replaceable covers, e.g., bucket-type containers, are commonly used to package and ship selected liquid and viscous materials in the nature of foods and food preparation materials, cosmetic preparations, detergents, and the like. Such containers are sturdy, typically having a wall thickness in the range of about 0.075 inches to about 0.090 inches, and have a large mouth that renders them well suited for storing and dispensing a variety of viscous liquids, e.g., syrups, mustard, and cosmetic preparations. A typical 20 liter empty bucket may weigh approximately 2.25 lbs.

Another mode of shipping liquid products is the "bag & box" arrangement in which a bag, made of flexible single or double ply plastic film and provided with a fitment for discharge of the bag's contents, is stored in a box made of corrugated cardboard. The latter type of packaging system is well suited for free-flowing liquids such as vinegar, wine, detergents, and the like. However, it is not well suited for viscous materials for a number of reasons. For example, it is difficult to remove all of the contents from the bag, due to the inability to scrape out the residual contents from the bag. Additionally, in the case of a material that consists of several ingredients that tend to separate from one another on standing, it is not possible to introduce a stirring implement into the bag for the purpose of mixing the contents to obtain a homogenous material.

Further limitations stem from plastic recycling requirements and food packaging regulations. Environmental regulations require containers with a volume of 5 gallons or less to be made of a recyclable material. Additionally, governmental regulations require that plastic containers for foodstuffs be made of a virgin plastic material. The substantially rigid plastic containers comprise a relatively large amount of plastic in comparison to the flexible bags used in the "bag & box" packaging system, thereby increasing the amount of plastic that has to be disposed of or recycled. Making such containers of virgin plastic is costly and hence discourages their use for containing foodstuffs. The "bag & box" system employs less plastic, but the bags are not as sturdy as the substantially stiff containers and also cannot be used where it is essential to access all of the contents or where it is desired to mix the contents in situ.

BRIEF SUMMARY OF THE INVENTION

The present disclosure relates to a packaging system and more particularly to a sustainable packaging system including a carton and a sealed liner assembly for shipping liquid, viscous, or particulate products. The present disclosure in one embodiment, relates to a packaging assembly for holding liquids, viscous material, or particulate material. The packaging assembly includes a carton having side and bottom walls. The packaging assembly also includes a self-supporting plastic liner that fits inside of the carton for containing liquids, viscous material, or particulate material. The liner has either a substantially circular or substantially oval cylindrical side wall, a closed bottom end characterized by a bottom wall formed integral with said side wall, and an open top end having an outwardly-projecting rim. The rim has a radially-extending flange portion, and a dependent skirt portion, wherein when the self-supporting plastic liner is inside of the carton, the radially extending flange portion supports the liner on at least a portion of the carton. A lidding material is provided to seal the plastic liner.

The present disclosure, in another embodiment, relates to a packaging assembly for holding liquids, viscous material, or particulate material. The packaging system includes a carton having side, top, and bottom walls, and a carton lid near the top wall. The carton has a tear strip or perforation dividing the carton lid from the remainder of the carton. A self-supporting plastic liner is provided inside of the carton for containing liquids, viscous material, or particulate material. The liner may or may not be attached to the carton. The liner has a side wall, a closed bottom end characterized by a bottom wall formed integral with said side wall, and an open top end having an outwardly-projecting rim. The rim has a radially-extending flange portion, and a dependent skirt portion, wherein the radially extending flange portion supports the liner on at least a portion of the carton. Separation along the tear strip or perforation allows the carton lid to at least partially open and expose the liner within the carton.

While multiple embodiments are disclosed, still other embodiments of the present disclosure will become apparent to those skilled in the art from the following detailed description, which shows and describes illustrative embodiments of the disclosure. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the disclosure will be better understood from the following description taken in conjunction with the accompanying Figures, in which:

DETAILED DESCRIPTION

The present disclosure relates to a novel and advantageous sustainable packaging system that may be used to ship liquid or viscous products or particulate matter. Traditionally, liquid products, for example thick viscous products such as thick paints and inks, cosmetic compounds, food glazes and fillings, drywall mud, thick roof sealants, powders and flakes, or like products have been packed for shipping or sale in pails or buckets made of materials such as steel or thick plastic. A single traditional 20 liter bucket of this type may weigh approximately 2.25 pounds empty, which adds a considerable amount of weight to a truckload of product. Buckets or pails are also typically cylindrically shaped, making them inefficient for skidding or shipping because there is a substantial amount of unused space between one bucket and the next bucket. Further, due to the rigidity of the buckets, they may take up a significant amount of space after use, but before disposal. Additionally, the buckets may be difficult or costly to dispose of or recycle.

The packaging system of the present disclosure generally includes an outer container or carton box, and an inner liner. The inner liner may be sealed after the liner is filled with product. A liner cover may be placed over the sealed liner and/or a carton box cover may be placed over the cardboard box containing the sealed and filled inner liner. The square or rectangular shape of the packaging system allows one box to be placed directly next to and/or on top of another box, effectively maximizing the amount of product that can be stored or shipped in a limited space. For shipping purposes, the more units that can be loaded per truck reduces inbound transportation costs.

In addition to the advantageous shape of the packaging system of the present disclosure, a single empty packaging system, in one embodiment, may weigh approximately 0.3 pounds, compared to the approximately 2.25 pounds for a traditional pail of similar volume. This weight difference results in a 7.5 to 1 ratio in weight savings for the packaging system of the present disclosure over the traditional pail. The lighter weight packaging system of the present disclosure may be easier to move, be less costly to ship, require less energy to produce, and be easier to recycle, and easier to store prior to recycling than traditional pails.

Figure 1A:
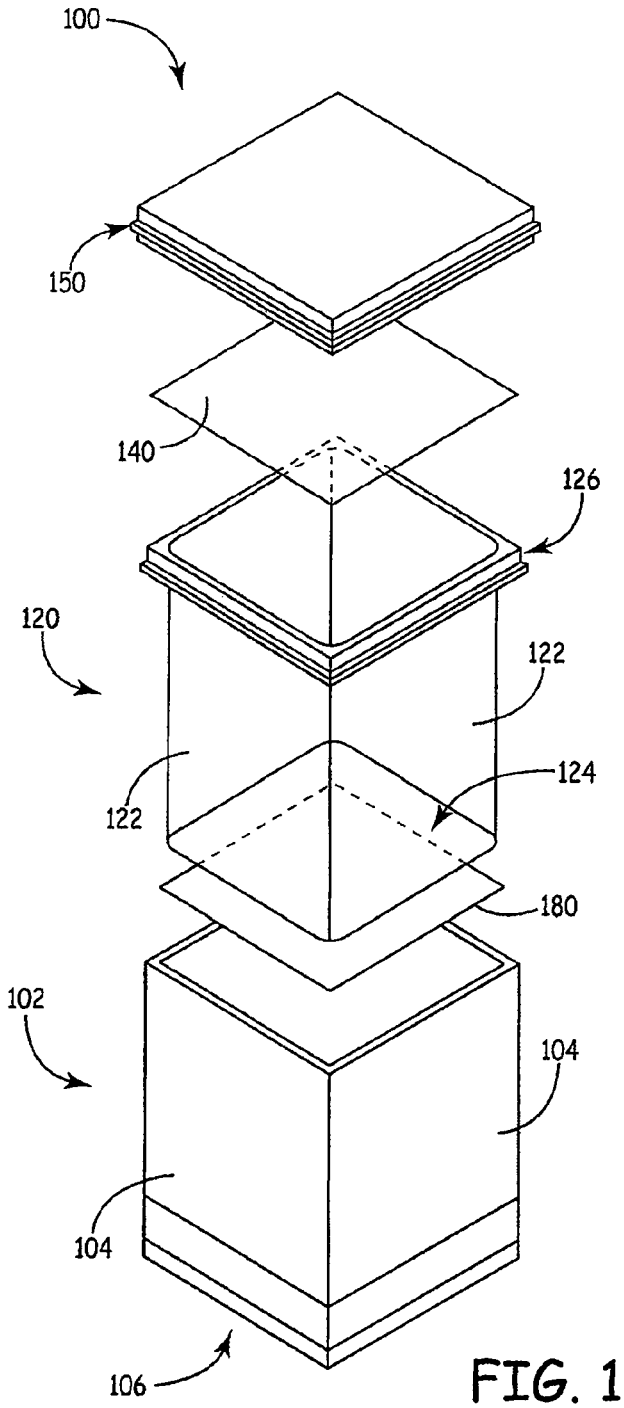
FIG. 1*a* is an exploded perspective view of the components of a packaging system according to one embodiment of the present disclosure.

FIG. 1A shows an embodiment of the packaging system 100 of the present disclosure. The embodiment of the packaging system 100 may include a carton 102, an optional pad or liner 180, a plastic liner 120, a lidding material 140 that may be sealed to the plastic liner 120, and a plastic lid 150. The carton 102 may be a conventional cardboard box constructed of, for instance, corrugated cardboard and a stiff paperboard that may be 100% recyclable, although, other light and/or recyclable materials may be used for the carton. The carton 102 may have a generally square or rectangular cross-sectional shape. Carton 102 may have a sidewall including four square or rectangular panels 104, a bottom wall 106, and in some embodiments, an open top without any flaps that need to be closed and/or sealed.

In one embodiment, the liner 120 may be made of plastic and be relatively semi-rigid and thin, approximately in the range of about 0.008 inches to about 0.030 inches thick. However, it is recognized that the liner thickness could vary and could be outside the range of about 0.008 inches to about 0.030 inches, and in some embodiments, may depend on the desired use or application of the liner 120. The liner 120 may be made by any means known in the art, such as, but not limited to vacuum forming, blow molding, or injection molding. The liner 120 may be made, for example, of a 100% recyclable material, such as, but not limited to high-density polyethylene (HDPE) or linear low density polyethylene (LLDPE). Unlike the plastic film bags used in the bag & box arrangement described above, the liner 120 may be self-supporting. However, the relative thinness of the liner may make the liner easily collapsible, which may significantly reduce the volume and cost of disposal as compared to traditional pails. Due to the thinness and/or the weight of the carton 102 and/or the liner 120, more, and in some cases significantly more, liners may be shipped via truck than traditional rigid buckets. For instance, the liner may be shipped in truck loads of approximately 28,000 units compared to only 3,412 traditional buckets per truck. Increasing the number of liners that may be shipped in a single truck load can advantageously result in less truck loads needed to ship the packaging system of the present disclosure and therefore less greenhouse gases being produced.

Figure 2:
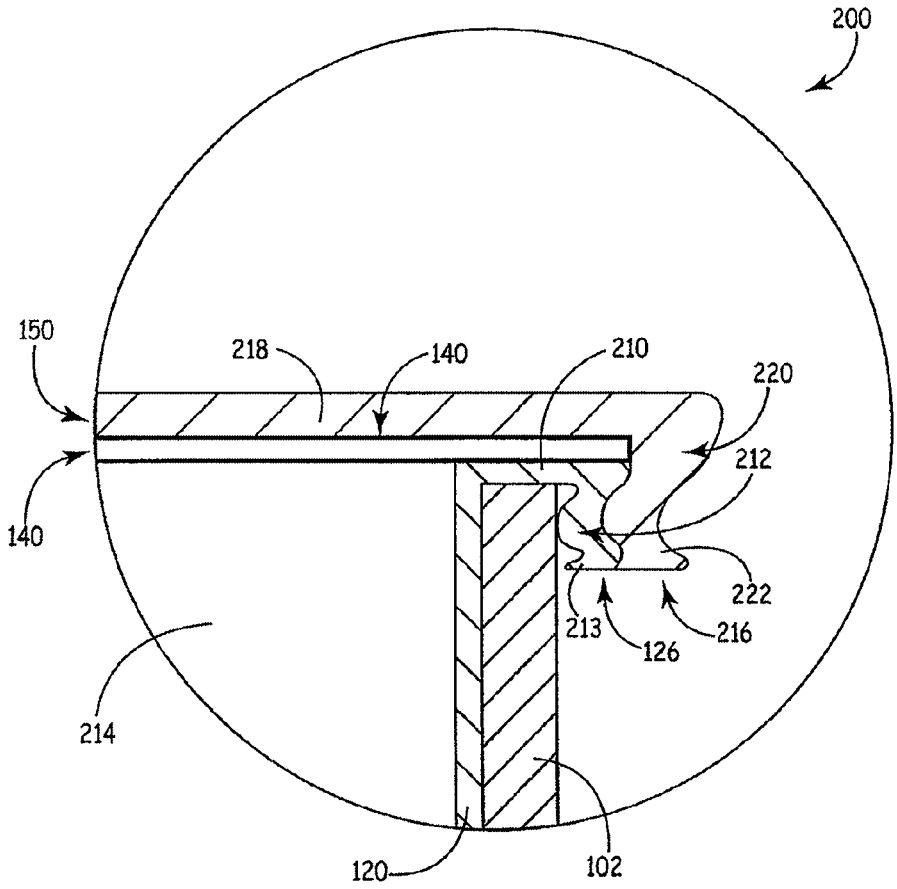
FIG. 2 is an enlarged fragmentary sectional view illustrating the components of a packaging system according to one embodiment of the present disclosure.

The liner 120 may have a cross-sectional shape similar to the carton 102, e.g., square or rectangular cross-sectional shape. Alternately, the liner may have any other shape, such as, but not limited to an oval or round cylindrical shape, as described in more detail below. In any case, the liner 120 can be sized to fit within the carton 102. In the illustrated embodiment, the liner 120 has a substantially square cross-sectional configuration and comprises a bottom wall 124 and a side wall including four sides or panels 122 that can be substantially similar in shape to panels 104 of carton 102. When the plastic liner 120 is inside the carton 102, the plastic liner 120 may rest on and be supported by the bottom wall 106 of the carton 102. Panels 122 may typically be generally slightly smaller than panels 104 of carton so as to permit the liner 120 to fit inside the carton 102. In one embodiment, panels 122 of the plastic liner 120 may lie substantially close to the side walls 104 of the carton 102 when the liner is placed in the carton. The top end of the liner 120 can be open but may be formed with a rim 126. As can best be seen in FIG. 2, the rim 126 of the liner 120 may include a radially extending flange portion 210 and a depending skirt portion 212. The rim 126 may extend fully around the perimeter of the liner 120, being an integral extension of the upper end of the panels 122. In another embodiment, the rim may extend partly around the perimeter of the liner. When the liner 120 is placed in the carton, the top edge of the carton sidewall 104 can be positioned underneath the rim 126 of the liner 120 as can be seen in FIG. 2, with the top edge of the sidewall 104 between the sidewall of the liner 120 and the skirt portion 212.

Figure 1B:
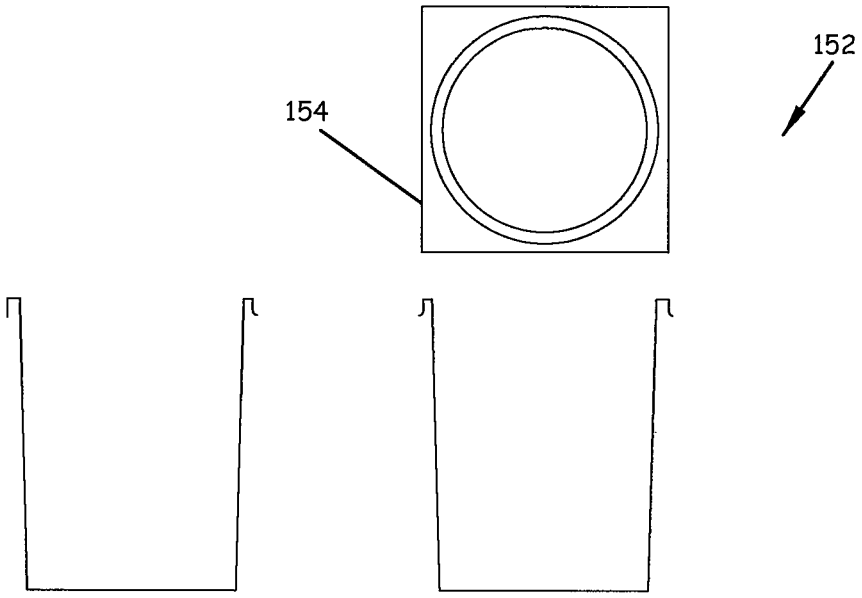
FIG. 1*b* is a top, end, and side view of a round cylindrical liner according to one embodiment of the present disclosure.

As stated above, the liner may have any other suitable shape. For example, in one embodiment, as shown in FIG. 1*b*, a liner 152 may have a substantially circular cross-sectional shape, sized to fit within the carton 102. The top of the liner 152, in one embodiment, may retain a square or rectangular shaped rim 154, such that the rim may extend fully around the perimeter of the liner 152, being an integral extension of the upper end of the liner. In a further embodiment, the rim may extend partly around the perimeter of the liner.

Figure 1C:
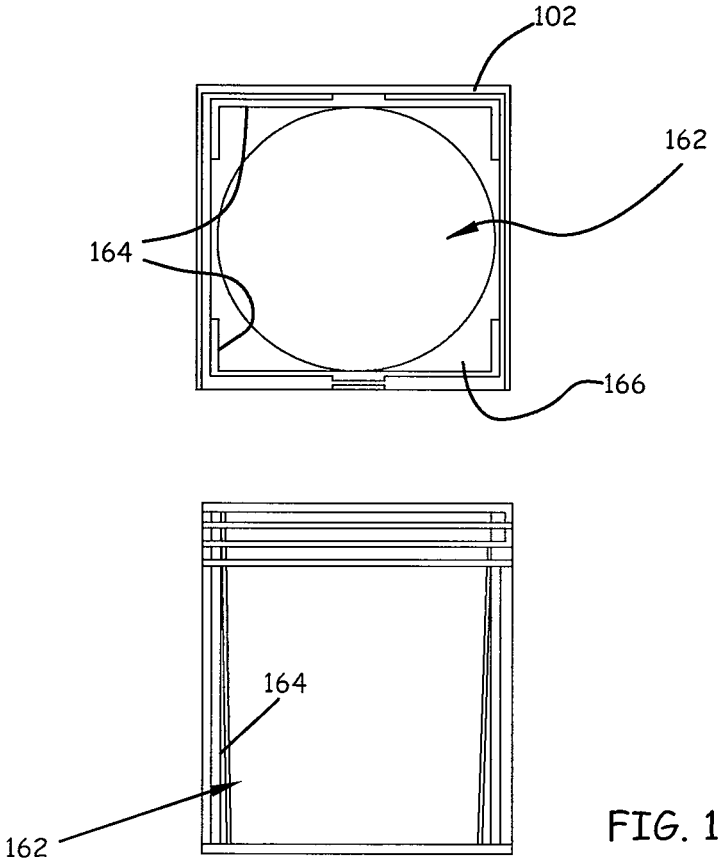
FIG. 1*c* is a top and side view of a packaging system with a round cylindrical liner according to another embodiment of the present disclosure.

In another embodiment of a liner having a substantially circular cross-sectional shape, sized to fit within the carton 102, as shown in FIG. 1*c*, a liner 162 may be designed to fit generally within the carton 102. The carton 102 may include additional inner side panels 164. The inner side panels 164 may extend substantially around the entire inner perimeter of the sidewall panels 104, or they may extend around only a portion of the inner perimeter of the sidewall panels 104. Although not necessary, the inner side panels 164, in some embodiments, may be slightly taller than the outer panels 104. The liner 162 may retain a square or rectangular shaped rim 166, which may extend fully or partly around the perimeter of the liner, and may rest upon an upper edge of the inner side panels 164. The liner 162 may be positioned with the rim 166 over a top edge of the inner side panels 164 entirely within the carton sidewall panels 104 or in addition to being over a top edge of the sidewall panels 104.

Figure 1D:
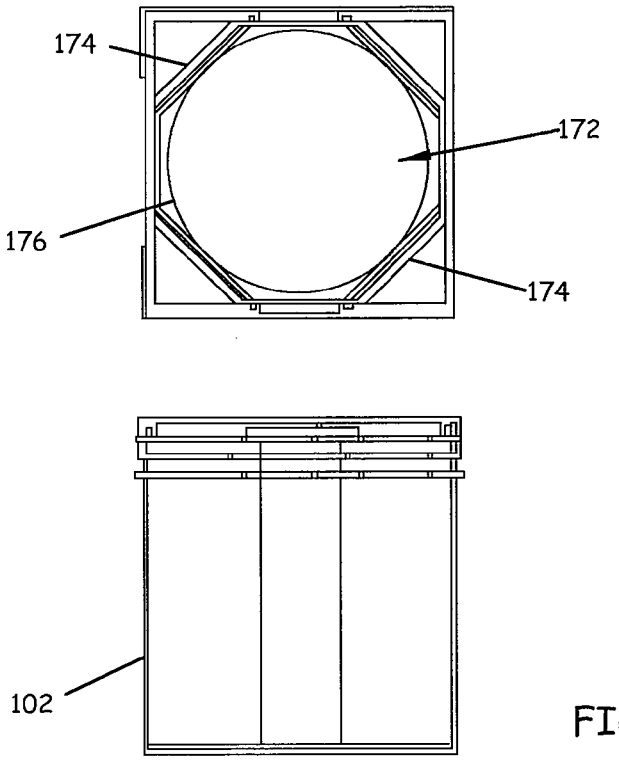
FIG. 1*d* is a top and side view of a packaging system with a round cylindrical liner according to another embodiment of the present disclosure.

In yet another embodiment of a liner having a substantially circular cross-sectional shape, sized to fit within the carton 102, as shown in FIG. 1*d*, a liner 172 may be designed to fit generally within the carton 102. The carton 102 may include additional inner side panels 174, providing an internal octagonal geometry, or other suitable polygonal geometry. The inner side panels 174 may extend substantially around the entire inner perimeter of the sidewall panels 104, or they may extend around only a portion of the inner perimeter of the sidewall panels 104, such as but not limited to, only extending across the corners of the carton sidewall panels 104. Although not necessary, the inner side panels 174, in some embodiments, may be slightly taller than the outer panels 104. The liner 172 may have a relatively smaller generally polygonal shaped rim 176, or the rim may be a substantially circular shaped rim, which may extend fully or partly around the perimeter of the liner. The octagonal inner side panels 174 at the corners of the carton sidewall panels 104 may include cutouts for the liner to pass through, thereby supporting the liner by way of the interface between the cutouts of the corner inner side panels and the substantially circular shaped rim 176.

Figure 1E:
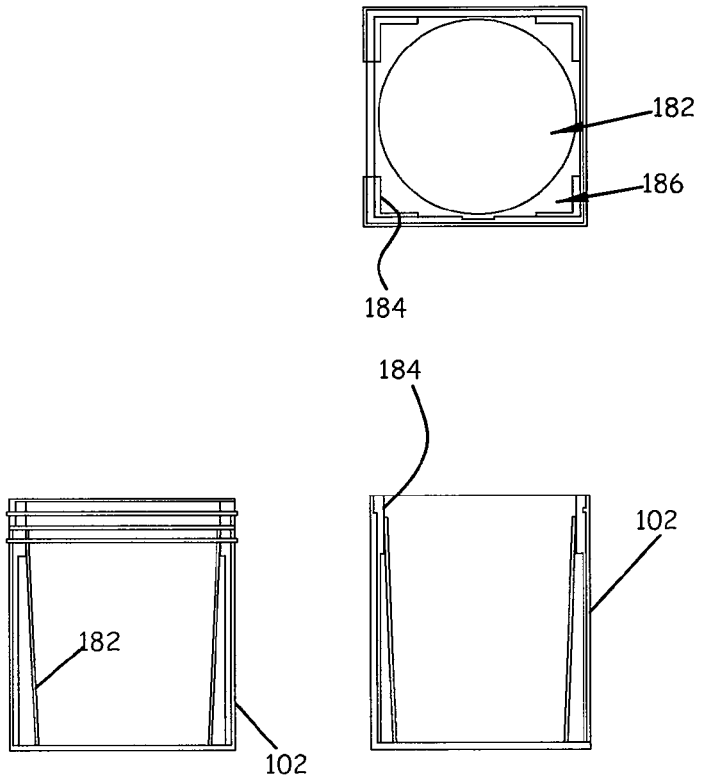
FIG. 1*e* is a top, end, and side view of a packaging system with a round cylindrical liner according to yet another embodiment of the present disclosure.

In still another embodiment of a liner having a substantially circular cross-sectional shape, sized to fit within the carton 102, as shown in FIG. 1*e*, a liner 182 may be designed to fit generally within the carton 102. The carton 102 may include additional inner side pads 184, which may be adhered to the carton sidewall panels 104, for example with adhesive. The inner side pads 184 need not be designed to extend the full height of the carton sidewall panels 104, but rather may be designed to be significantly shorter. The inner side pads 184 may extend substantially around the entire inner perimeter of the sidewall panels 104, or they may extend around only a portion of the inner perimeter of the sidewall panels 104. The liner 182 may retain a square or rectangular shaped rim 186, which may extend fully or partly around the perimeter of the liner, and may rest upon an upper edge of the inner side pads 184. The liner 182 may be positioned with the rim 186 over a top edge of the inner side pads 184 entirely within the carton sidewall panels 104 or in addition to being over a top edge of the sidewall panels 104.

Figure 1F:
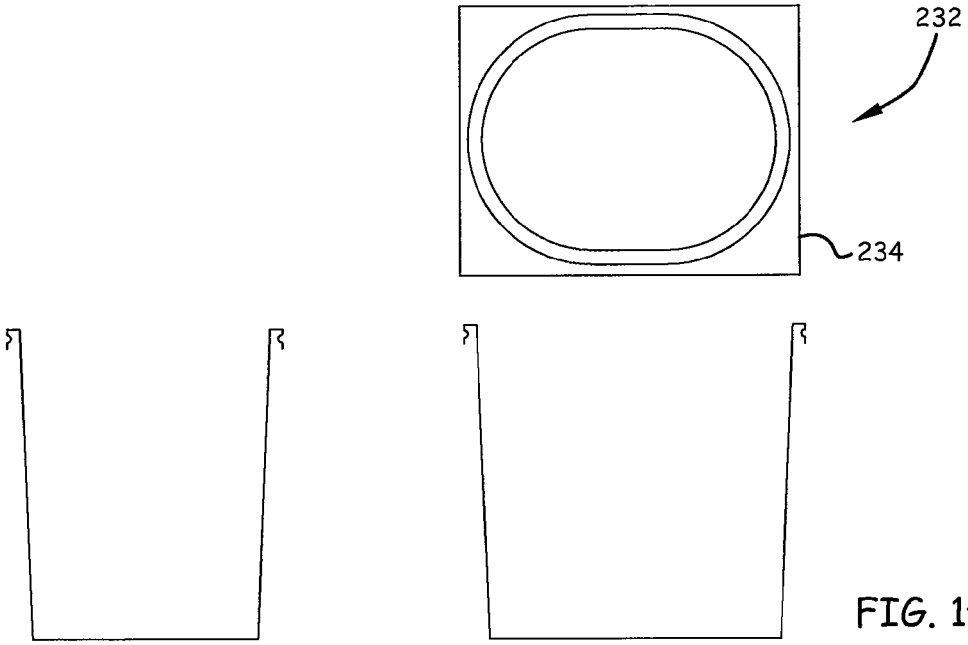
FIG. 1*f* is a top, end, and side view of a oval cylindrical liner according to one embodiment of the present disclosure.

In yet another example embodiment, as shown in FIG. 1*f*, a liner 232 may have a substantially oval cross-sectional shape, sized to fit within the carton 102. The top of the liner 232, in one embodiment, may retain a square or rectangular shaped rim 234, such that the rim may extend fully around the perimeter of the liner 232, being an integral extension of the upper end of the liner. In a further embodiment, the rim may extend partly around the perimeter of the liner.

Figure 1G:
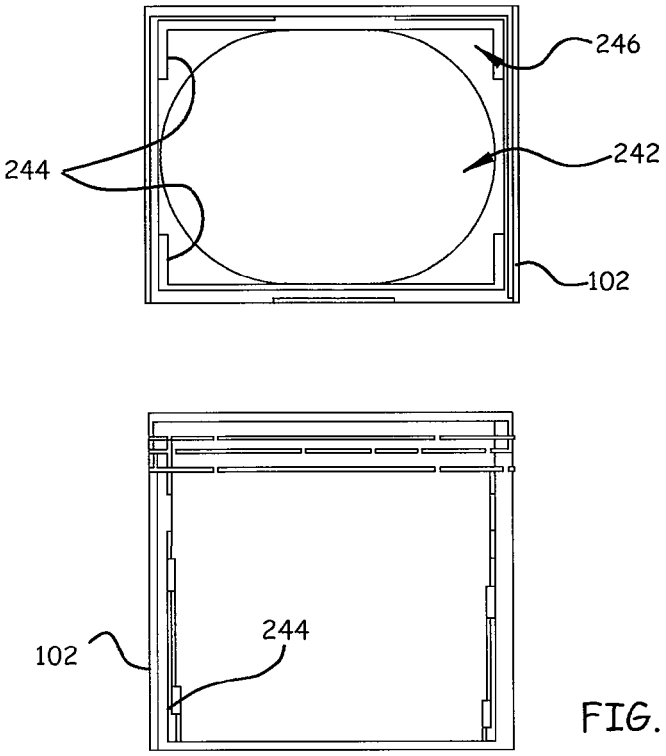
FIG. 1*g* is a top and side view of a packaging system with an oval cylindrical liner according to another embodiment of the present disclosure.

In another embodiment of a liner having a substantially oval cross-sectional shape, sized to fit within the carton 102, as shown in FIG. 1*g*, a liner 242 may be designed to fit generally within the carton 102. The carton 102 may include additional inner side panels 244. The inner side panels 164 may extend substantially around the entire inner perimeter of the sidewall panels 104, or they may extend around only a portion of the inner perimeter of the sidewall panels 104. Although not necessary, the inner side panels 244, in some embodiments, may be slightly taller than the outer panels 104. The liner 242 may retain a square or rectangular shaped rim 246, which may extend fully or partly around the perimeter of the liner, and may rest upon an upper edge of the inner side panels 244. The liner 242 may be positioned with the rim 246 over a top edge of the inner side panels 244 entirely within the carton sidewall panels 104 or in addition to being over a top edge of the sidewall panels 104.

Figure 1H:
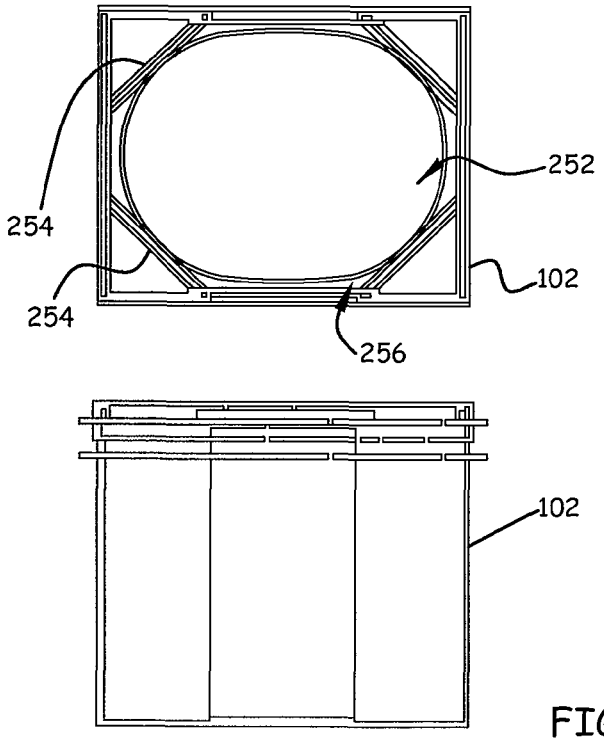
FIG. 1*h* is a top and side view of a packaging system with an oval cylindrical liner according to another embodiment of the present disclosure

In yet another embodiment of a liner having a substantially oval cross-sectional shape, sized to fit within the carton 102, as shown in FIG. 1*h*, a liner 252 may be designed to fit generally within the carton 102. The carton 102 may include additional inner side panels 254, providing an internal octagonal geometry, or other suitable polygonal geometry. The inner side panels 254 may extend substantially around the entire inner perimeter of the sidewall panels 104, or they may extend around only a portion of the inner perimeter of the sidewall panels 104, such as but not limited to, only extending across the corners of the carton sidewall panels 104. Although not necessary, the inner side panels 254, in some embodiments, may be slightly taller than the outer panels 104. The liner 252 may have a relatively smaller generally polygonal shaped rim 256, or the rim may be a substantially oval shaped rim, which may extend fully or partly around the perimeter of the liner. The octagonal inner side panels 254 at the corners of the carton sidewall panels 104 may include cutouts for the liner to pass through, thereby supporting the liner by way of the interface between the cutouts of the corner inner side panels and the substantially oval shaped rim 256.

Figure 1I:
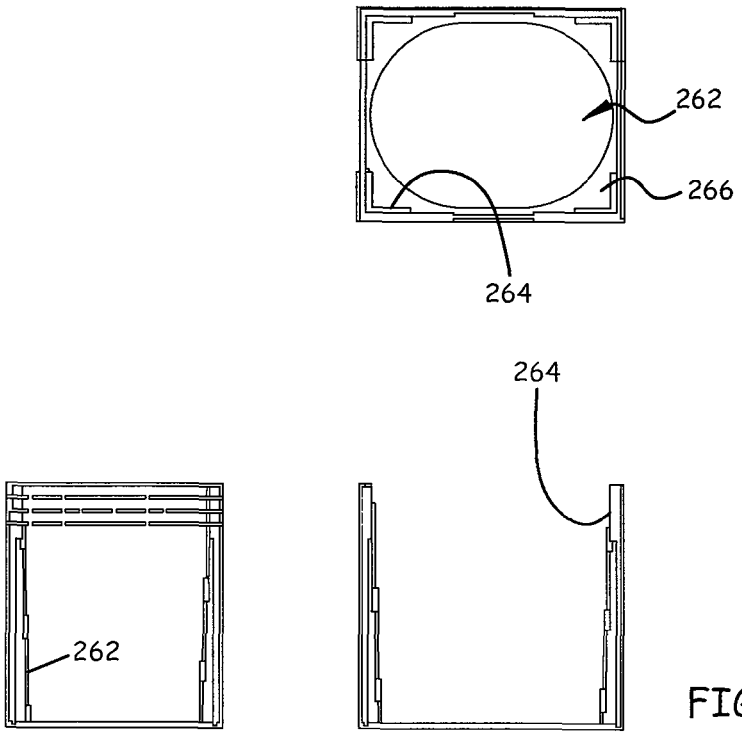
FIG. 1*i* is a top, end, and side view of a packaging system with an oval cylindrical liner according to yet another embodiment of the present disclosure

In still another embodiment of a liner having a substantially oval cross-sectional shape, sized to fit within the carton 102, as shown in FIG. 1*i*, a liner 262 may be designed to fit generally within the carton 102. The carton 102 may include additional inner side pads 264, which may be adhered to the carton sidewall panels 104. The inner side pads 264 need not be designed to extend the full height of the carton sidewall panels 104, but rather may be designed to be significantly shorter. The inner side pads 264 may extend substantially around the entire inner perimeter of the sidewall panels 104, or they may extend around only a portion of the inner perimeter of the sidewall panels 104. The liner 262 may retain a square or rectangular shaped rim 266, which may extend fully or partly around the perimeter of the liner, and may rest upon an upper edge of the inner side pads 264. The liner 262 may be positioned with the rim 266 over a top edge of the inner side pads 264 entirely within the carton sidewall panels 104 or in addition to being over a top edge of the sidewall panels 104.

Other options for supporting substantially circular or oval shaped liners within a carton having a square or rectangular cross-sectional shape are within the spirit and scope of the present disclosure. Although features may be generally described with reference herein to liner 120, it is understood that such features may also be equally applied to other liner embodiments, such as those described above.

A lidding material 140 may be sealed over the top of the liner 120 in order to contain the product within the liner 120. The lidding material 140 can be advantageous when the contents of the liner must be protected against moisture, air, bacteria, or other materials that may have a deleterious effect on the contents. The lidding material 140 may be, for example, a thin film plastic material or a thin metal foil that may be sealed to the liner 120 by any means, for example by hermetically heat-sealing the lidding material 140 to the liner 120. In other embodiments, the lidding material may be manufactured from any material suitable for sealing the liner from one or more of moisture, air, bacteria, or other materials that may have a deleterious effect on the contents. In some embodiments, the lidding material may be made of a 100% recyclable material. The lidding material may also be secured to the liner by adhesive or other methods of sealing now known or developed in the future. As can be seen in FIG. 2, the lidding material 140 may cover the entire open area 214 of the liner 120 and may be sealed to the radially extending flange 210 which runs along the perimeter of the sidewall 122 of the liner 120. In some embodiments, a packaging system may not contain a lidding material, but may contain either a plastic lid, a carton lid, or both a plastic lid and a carton lid, as will be described in detail below.

The packaging system 100 illustrated in FIG. 1A shows a plastic lid 150 that may fit over both the liner 120 and the carton 104 when the liner is placed inside the carton. FIG. 2 shows the plastic lid 150 secured over the rim 126 of the liner 120. The plastic lid 150 may be made of a resilient plastic or other suitable resilient material and be shaped to generally fit over the opening of the liner 120. By way of example but not limitation, the plastic lid may be made of the same material as the liner or some other material, and may have the same or different thickness. The plastic lid 150 may include a rim 216 that is designed to substantially interlock or otherwise removably couple with the rim 126 of the liner 120. As can best be seen in FIG. 2, the plastic lid 150 has a center portion 218 that may cover the lidding material 140 of the liner 120. In alternative embodiments, the center portion 218 or portions thereof, of the lid 150 may be eliminated. The rim 216 of the plastic lid 150 may include a skirt portion 220 that fits over, and in some cases snuggly over, the skirt portion 212 of the liner 120. The interlocking skirt portions 212, 220 of the liner 120 and plastic lid 150 may be of any configuration that permits a generally snug fit between the liner skirt portion 212 and the plastic lid skirt portion 220. In the embodiment shown in FIG. 2 the skirt portions 212, 220 are generally C-shaped, bulging outward, away from the boxing system, at the top of the skirt portion, then curving inward toward the boxing system, and then curving outward again forming a lip 213, 222 around the perimeter of both the liner and the plastic lid. However, it is recognized that any suitable interlocking or coupling mechanism or means may be used to removeably couple the lid 150 to the liner 120.

Figure 3:
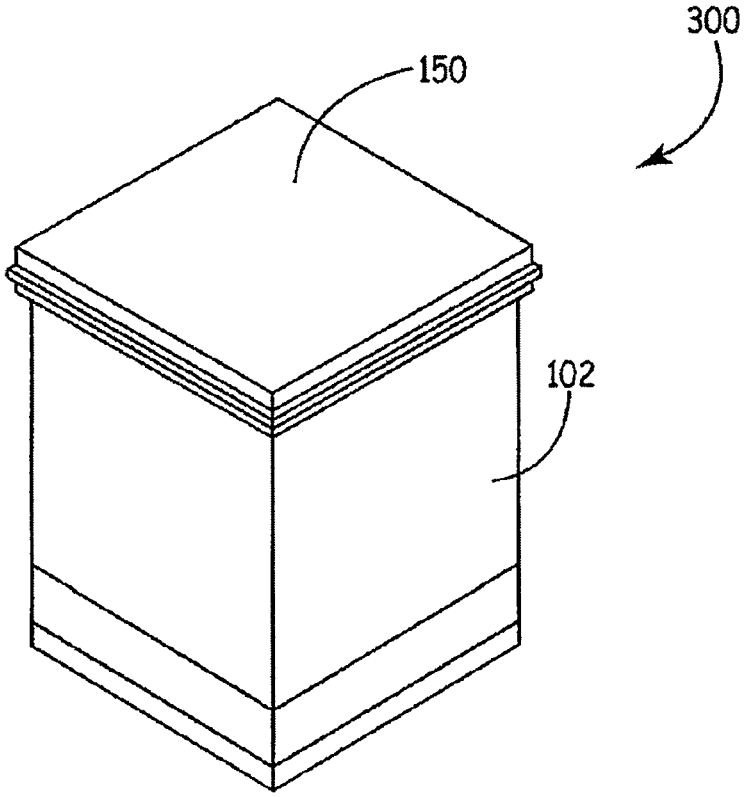
FIG. 3 is a perspective view of one embodiment of an assembled packaging system.

The plastic lid 150 may be attached to the liner 120 by pressing it down over the rim 126 of the liner 120. The pressing down action can result in the bottom end of the skirt portion 220 of the plastic lid 150 being forced outwardly far enough to snap over the skirt portion 212 of the liner 120. The inherent resilience of the plastic of which the plastic lid 150 is made can cause its rim 216 to engage, or tightly engage, with the liner rim 126 as shown in FIG. 2, thereby removeably locking the plastic lid 150 to the liner 120. The plastic lid 150 may be removed by urging it upwardly away from the liner 120, with the skirt portion 220 of the plastic lid flexing outwardly to release the plastic lid from the liner. FIG. 3 shows a carton 102 with a plastic lid 150 secured to a liner that is inside of the carton 102.

Figure 4B:
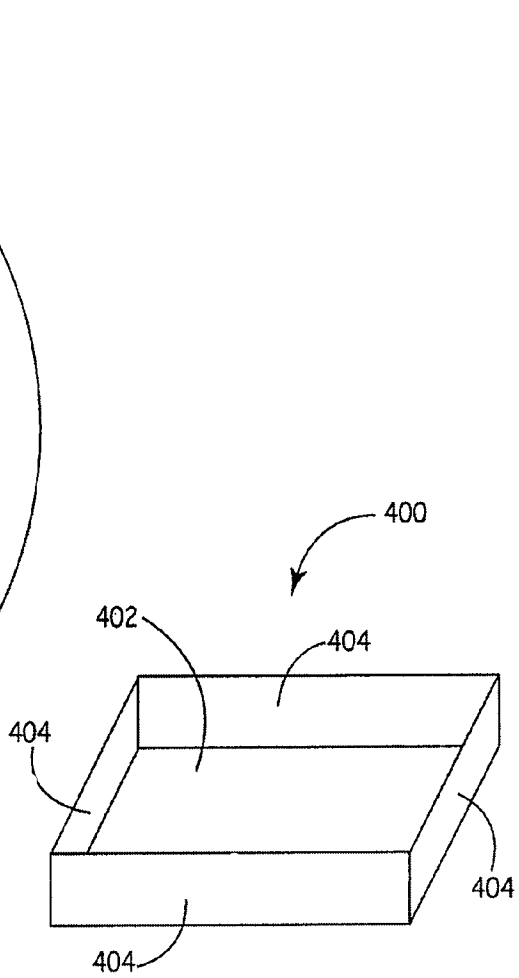
FIG. 4*b* is a perspective view of a carton lid according to one embodiment of the present disclosure.
Figure 4A:
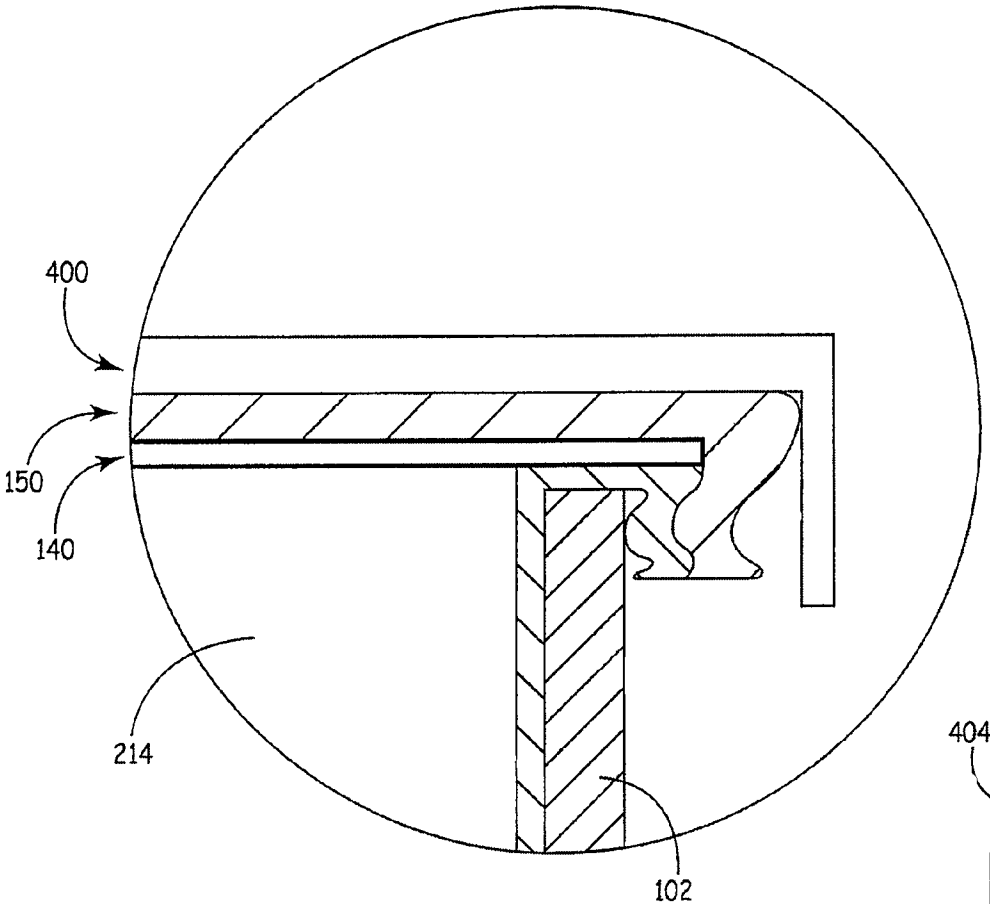
FIG. 4*a* is an enlarged fragmentary sectional view illustrating the components of a packaging system according to another embodiment of the present disclosure.

In another embodiment, the packaging system may have a carton lid in addition to or instead of a plastic lid. FIG. 4*a* shows a cross-section of an embodiment including both a plastic lid 150 and a carton lid 400. As shown in FIG. 4*b*, the carton lid 400 may be made of, for instance, corrugated cardboard and a stiff paperboard that may be 100% recyclable. By way of example, but not limitation, the carton lid 400 may be made of the same material as the carton 102 or some other material, and may have the same or different thickness. The carton lid 400 can be made to fit generally over the carton 102 and liner 120. FIG. 4*b* illustrates a carton lid 400 with an inner portion 402 and four side walls 404. The carton lid 400 can have substantially the same shaped cross-section as the carton it will cover, except that the, carton lid may be slightly bigger than the carton so that the carton lid may fit over, and in some cases securely over, the carton 102 and the liner 120. Thus, like the carton itself, the carton lid may be either square-shaped or rectangular-shaped.

Figure 4C:
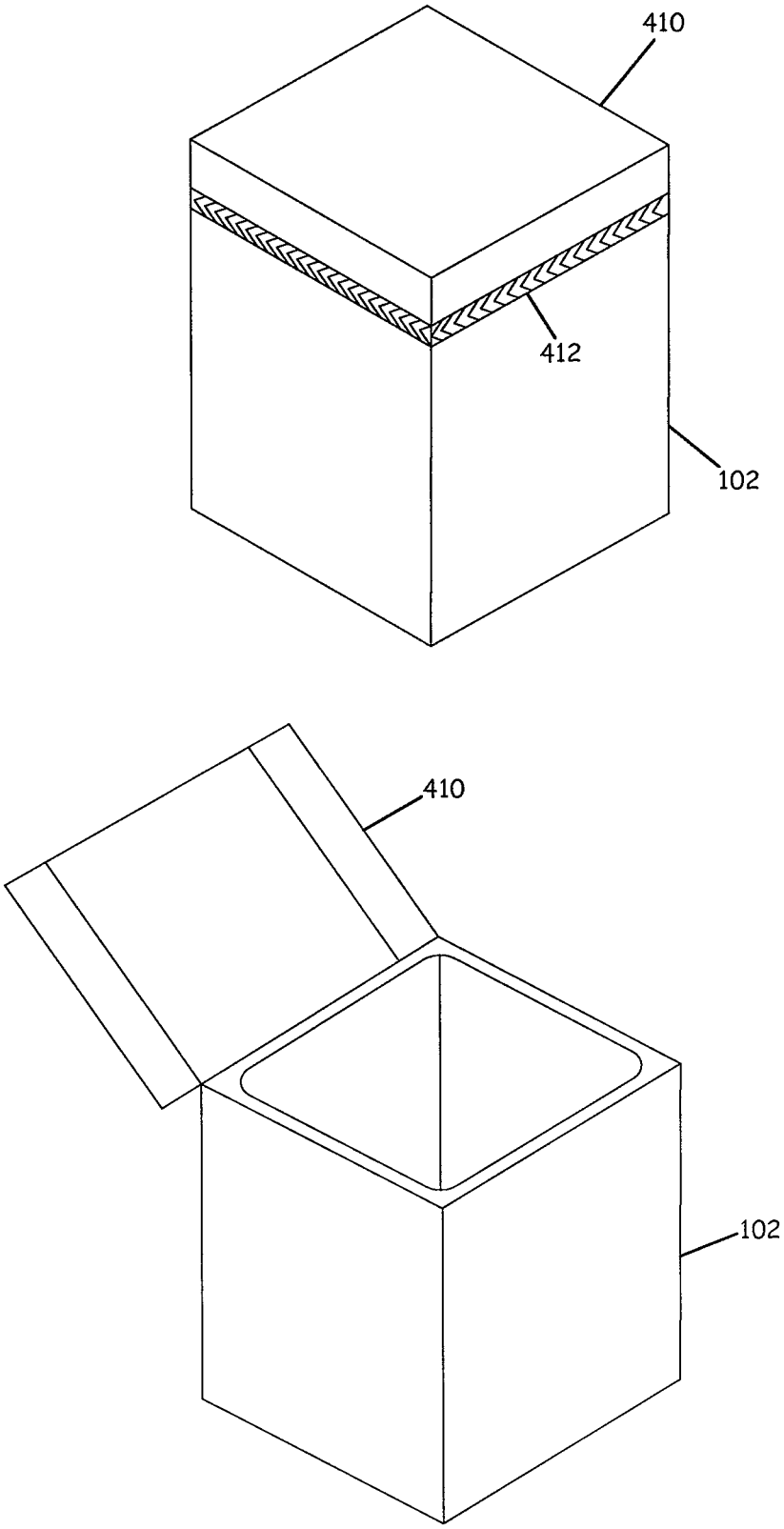
FIG. 4*c* includes perspective views of a carton and carton lid according to another embodiment of the present disclosure, utilizing a tear strip to separate the carton lid from the carton.

In a further embodiment, as shown in FIG. 4*c*, a carton lid 410 may be generally integral with the carton 102 and at least partially separable from the carton along a corrugated tear strip, pull string, or perforation 412. Although not required, this type of carton lid may be preferably used with embodiments of liners that fit entirely within the sidewall panels 104 of the carton. The tear strip 412 may be removed (or the pull string can be pulled, or the perforated line separated) so as to allow the carton lid 410 to at least partially separate from the carton 102. In some embodiments, the tear strip 412 may extend entirely around the carton 102, so as to allow the carton lid 410 to be fully removed from the carton to expose the liner within. In other embodiments, the tear strip 412 may extend only partially around, for example around three sides of the carton, so as to allow the carton lid 410 to be partially removed from the carton to expose the liner within, as shown in FIG. 4*c*. In either embodiment, the carton lid 410 may be reusable to reseal or re-cover the carton once access to the liner within is no longer desired. In further embodiments, the tear strip 412 may be located at any suitable position to allow a portion of the carton to open for access to the liner within.

In still another embodiment, the carton lid may be generally integral with the carton 102 and comprise one or more flaps, that may be folded over the carton opening to close the carton. The flaps may also include one or more tear strips to secure the flaps in a closed position until the carton is opened for the first time.

At any rate, in some embodiments the packaging system may include a carton 102, a liner 120, a lidding material 140, and a carton lid 400 without a plastic lid 150. In yet another embodiment the packaging system may include a carton 102, a liner 120, a plastic lid 150, and a carton lid 400 without a lidding material. In any event, the packaging system may be designed to include one, two, or each of the lidding material 140, plastic lid 150, and carton lid 400. For example, in some embodiments, the packaging system may include only the lidding material 140 without a plastic lid 150 or carton lid 400.

Figures 5A, 5B, 5C:
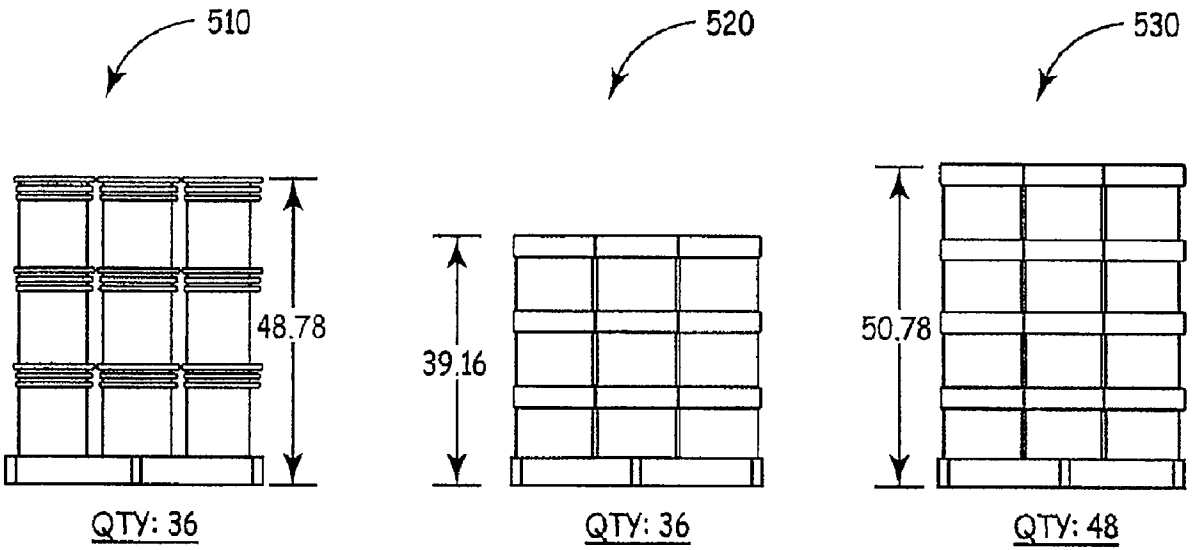
FIG. 5*a* is a perspective view of traditional packing buckets skidded on a pallet.
FIG. 5*b* is a perspective view of an embodiment of the present disclosure skidded on a pallet with 36 packaging assemblies.
FIG. 5*c* is a perspective view of an embodiment of the present disclosure skidded on a pallet with 48 packaging assemblies.

Because traditional pails or buckets that are used to ship viscous materials are typically cylindrical, a significant amount of space may be wasted during shipping because one bucket can not line up directly next to another bucket as can be seen in FIG. 5*a*. Further, because traditional pails are so thick, each bucket takes up more space, and in some cases significantly more space, than the packaging system of the present disclosure. This can best be seen in FIGS. 5*a* and 5*b* which show how the same quantity of product would be skidded in the present disclosure 520 and in the traditional bucket system 510. As can been seen, each skid 510, 520 contains 36 units, however, the height of the skidded present disclosure 520 is considerably less than the height of the skidded traditional bucket 510. In fact, adding another layer of the packaging system of the present disclosure to the skid 520 may only increase the height of the skid by a small amount, such as a couple inches, compared to the traditional bucket system 510 as shown in FIGS. 5*a* and 5*c*. Adding this additional layer can result in more product per skid, and in some cases up to 33% or more product. In addition to being able to store and/or ship more, and in some cases significantly more, product by means of the present disclosure, the same quantity of product weighs less, and in some cases significantly less, when packaged using the present disclosure rather than the traditional buckets. This may make product packaged using the present disclosure easier to move, and in some cases less costly to ship.

In practice, the liner of the present disclosure may be filled with a liquid, viscous material or particulate material before the liner is placed in the carton, or while the liner is in the carton. In existing conventional packaging systems, a liner might also be filled before being placed inside a box, or after being placed in a box. However, if a sealing member was going to be applied to the liner, the liner would have to be filled before being placed in the box. In that case, a sleeve or support member would need to be placed around the liner to stabilize the liner. Alternately, in conventional packaging systems, the liner could be placed inside the box and then filled with material, but in that case, the liner could not be sealed with a lidding material. One such existing packaging system is described in U.S. Pat. No. 6,892,933, the entirety of which is hereby incorporated by reference herein. One novel and advantageous aspect of some embodiments of the present disclosure, however, is that the liner may be filled when it is in the carton, and the lidding material may be sealed to the liner after the liner has been filled, and while the liner is still in the carton.

Figure 6:
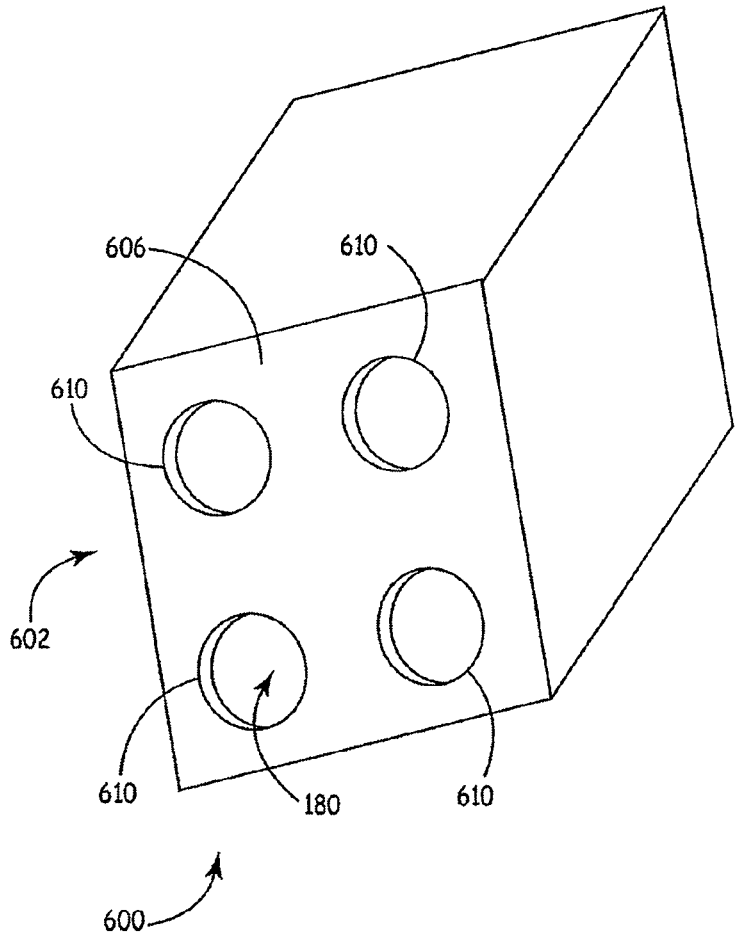
FIG. 6 is a perspective view of the bottom wall of a carton with four round liner access points, according to one embodiment of the present disclosure.

A further embodiment of the present disclosure illustrated in FIG. 6 shows the bottom wall 606 of a carton 602. In this embodiment, the bottom wall 606 may contain liner access points 610. While four liner access points 610 are shown, it is recognized that fewer or greater liner access points 610 may be used as suitable or desirable for the intended application. In the embodiment shown, the liner access points 610 are round, but they may be any shape, such as but not limited to square, rectangular, triangular, oblong, etc. The liner access points 610 are areas that are cut out or otherwise removed from the bottom wall 602 creating openings in the bottom wall 602, such that when the liner 120 is inside the carton 602, the liner may be accessed and pushed up from the bottom of the carton 602. During the packing process, the liner 120 may be placed in the carton 602 in order to fill the liner 120 with material. Prior to sealing the lidding material 140 on the liner 120, the liner 120 may be pushed up, for example, approximately ½ inch to 1½ inches, or any other suitable amount, in order to seal the lidding material 140 on the liner 120. The liner 120 may be raised for sealing by pushing up on the liner 120 through the liner access points 610 in the bottom wall 606 of the carton 602.

In some embodiments, a liner pad 180, as shown in FIGS. 1 and 6, may be removeably placed inside of the carton 602 prior to placing the liner in the carton. The pad 180 may rest between the bottom wall 606 of the carton 602 and the bottom of the liner. When the liner is pushed up for sealing through the liner access points 610, the pad 180 may equalize the pressure applied to the liner and help stabilize the liner, allowing the filled liner to keep its shape as it is pushed upward. The pad 180 may be made of corrugated cardboard. In other embodiments, the pad may be made of another paper material, plastic, wood, metal, or any other suitable material, or combination of materials. In one embodiment, the pad 180 may be of any desirable thickness. For instance, a relatively thin pad may be used with liners that are not intended to be very heavy when filled, whereas a thicker pad may be desirable when the filled liner is expected to be heavy. In other embodiments, a pad may not be used at all. In some embodiments, the pad 180 may be square or rectangular in shape and sized to fit snuggly within the perimeter of the square or rectangular panels 104 of the sidewall of the carton 602. In alternative embodiments, the pad 180 may be shaped other than as a square or rectangular, such as but not limited to circular, triangular, ovoid, etc. Similarly, the pad 180 need not be sized to fit snuggly within the perimeter of the square or rectangular panels 104 of the sidewall of the carton 602, and in some embodiments the pad 180 may be sized such that the pad 180 covers at least a portion of one or more of the liner access points 610. Liner access points and liner pads may be suitably used with any liner of the present disclosure, and may further be applied to existing packaging system, such as but not limited to, those described in U.S. Pat. No. 6,892,933, which was previously incorporated by reference herein.

Once the filled liner has been covered with a lidding material, a plastic lid may be applied to the liner. Additionally, a carton lid may cover the plastic lid. In other embodiments, as mentioned previously, only a carton lid may cover the lidding material of the liner. The packaging system may then be shrink wrapped or banded for skidding and shipping.

Figure 7:
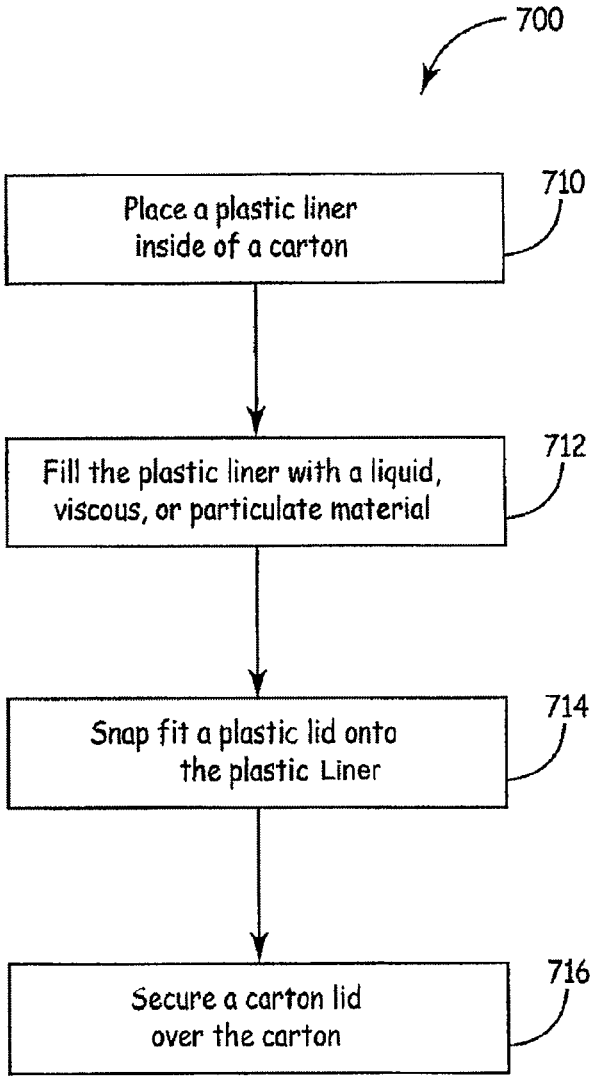
FIG. 7 is a flow diagram illustrating a method for packaging and holding liquid, viscous, and particulate materials, according to one embodiment of the present disclosure.

A further embodiment of the present disclosure is a method for packaging and holding liquids, viscous, or particulate materials as illustrated in FIG. 7. In one embodiment, a plastic liner may be placed inside of a carton 710, either with the rim of the liner extending over the top edge of the carton or positioned entirely within the exterior walls of the carton. Once the liner is inside of the carton, the liner may be filled with a liquid, viscous, or particulate material, or any combination thereof 712. After the liner has been filled, in some embodiments, a plastic lid may be snap fit onto the plastic liner to secure the contents of the liner within 714. In some embodiments a carton lid may be secured over the plastic lid 716.

In another embodiment of the present disclosure, a lidding material is affixed to the plastic liner after the plastic liner has been filled with product. In some embodiments, the affixing of the lidding material may be facilitated by pushing the plastic liner up and away from the carton so as to more easily access and seal the lidding material onto the rim of the plastic liner. The plastic liner may be pushed up through liner access points in the bottom of the carton, as described above.

Another advantage of the present disclosure is that the system may be integrated into already existing single and multi-head filling lines. Furthermore, the carton 102 may be assembled using standard equipment. The liner 120 may be installed, and the carton 102 and liner 120 may be conveyed to the existing filler. Once the liner 120 has been filled with product, a lidding material 140 may be heat sealed in place to protect the product. A plastic lid 150 may, or may not be, installed over the liner 120. A secondary or tertiary carton lid 400 may, or may not be, installed over the packaging system to protect the package during shipping. Then the packaging system may be shrink wrapped or banded for skidding and shipping.

In the foregoing description various embodiments of the present disclosure have been presented for the purpose of illustration and description. They are not intended to be exhaustive or to limit the invention to the precise form disclosed. Obvious modifications or variations are possible in light of the above teachings. The embodiments were chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

We claim:

1. A packaging assembly for holding liquids, viscous material, or particulate material comprising:

a cardboard carton having carton side walls and a carton bottom wall, the carton side walls having upper portions extending from a top of the carton and defining a carton exterior, the carton side walls extending from the upper portions to a bottom of the carton;

a self-supporting plastic liner having a liner side wall that fits inside of the carton, the plastic liner being self supported to include an outwardly-projecting rim that comprises a radially-extending flange portion and a skirt portion dependent therefrom, wherein the self-supporting plastic liner is configured for containing liquids, viscous material, or particulate material, said liner having a closed bottom end characterized by a liner bottom wall formed integral with said liner side wall, and an open top end having the outwardly-projecting rim, and the dependent skirt portion at least partially extending over said upper portions of the carton side walls, wherein when the self-supporting plastic liner is inside of the carton, the radially extending flange portion supports the liner on the upper portions of the carton side walls; and a lidding material configured to seal the plastic liner.

2. A packaging assembly according to claim 1, further comprising a carton lid fitting over the liner.

3. A packaging assembly according to claim 1, wherein the carton comprises inner side walls for supporting the radially extending flange portion.

4. A packaging assembly according to claim 1, wherein the plastic liner is made of polyethylene.

5. A packaging assembly according to claim 1, wherein the plastic liner rests on and is supported by the carton bottom wall.

6. A packaging assembly according to claim 1, wherein the lidding material is detachably sealed to the plastic liner to seal the interior of the plastic liner.

7. A packaging assembly of claim 1, wherein the liner is semi-rigid.

8. A packaging assembly of claim 1, wherein the liner side wall and the rim portion are of unitary construction.

9. A packaging assembly of claim 1, wherein the carton side walls together form a substantially rectangular shaped cross-section.

10. A packaging assembly of claim 1, wherein the carton side walls extend vertically straight substantially continuously from the top of the carton to the bottom of the carton.

11. A packaging assembly of claim 1, wherein the rim has a vertical height, and wherein the upper portion of the carton side walls extend the entire vertical height of the rim.

12. A packaging assembly of claim 1, wherein the carton sidewalls are vertical, and wherein the upper portions extend from the top of the carton and define a carton exterior that is substantially vertically straight.

13. A packaging assembly for holding liquids, viscous material, or particulate material comprising:

a carton having carton side walls and a carton bottom wall, the carton side walls having upper portions extending from a top of the carton and defining a carton exterior that is substantially vertically straight, the carton side walls extending from the upper portions to a bottom of the carton;

a self-supporting plastic liner having a liner side wall that fits inside of the carton, the plastic liner being self supported to include an outwardly-projecting rim that comprises a radially-extending flange portion and a skirt portion dependent therefrom, wherein the self-supporting plastic liner is configured for containing liquids, viscous material, or particulate material, said liner having a closed bottom end characterized by a liner bottom wall formed integral with said liner side wall, and an open top end having the outwardly-projecting rim, and the dependent skirt portion at least partially extending over said upper portions of the carton side walls, wherein when the self-supporting plastic liner is inside of the carton, the radially extending flange portion supports the liner on the upper portions of the carton side walls, and wherein the rim has a vertical height and the upper portion of the carton side walls extend the entire vertical height of the rim; and a lidding material configured to seal the plastic liner.

14. A packaging assembly according to claim 13, further comprising a carton lid fitting over the liner.

15. A packaging assembly according to claim 13, wherein the carton comprises inner side walls for supporting the radially extending flange portion.

16. A packaging assembly according to claim 13, wherein the plastic liner is made of polyethylene.

17. A packaging assembly according to claim 13, wherein the plastic liner rests on and is supported by the carton bottom wall.

18. A packaging assembly according to claim 13, wherein the lidding material is detachably sealed to the plastic liner to seal the interior of the plastic liner.

19. A packaging assembly of claim 13, wherein the liner is semi-rigid.

20. A packaging assembly of claim 13, wherein the liner side wall and the rim portion are of unitary construction.

21. A packaging assembly of claim 13, wherein the carton side walls together form a substantially rectangular shaped cross-section.

22. A packaging assembly of claim 13, wherein the carton side walls extend vertically straight substantially continuously from the top of the carton to the bottom of the carton.

23. A packaging assembly of claim 13, wherein the carton is a cardboard carton.

24. A packaging assembly of claim 13, wherein the carton sidewalls are vertical.

* * * * *